US010041195B2

(12) United States Patent
Ge et al.

(10) Patent No.: US 10,041,195 B2
(45) Date of Patent: Aug. 7, 2018

(54) WOVEN SIGNAL-ROUTING SUBSTRATE FOR WEARABLE ELECTRONIC DEVICES

(71) Applicant: FREESCALE SEMICONDUCTOR, INC., Austin, TX (US)

(72) Inventors: You Ge, Tianjin (CN); Meng Kong Lye, Petaling Jaya (MY); Zhijie Wang, Tianjin (CN)

(73) Assignee: NXP USA, INC., Austin, TX (US)

( * ) Notice: Subject to any disclaimer, the term of this patent is extended or adjusted under 35 U.S.C. 154(b) by 400 days.

(21) Appl. No.: 14/989,591

(22) Filed: Jan. 6, 2016

(65) Prior Publication Data

US 2017/0009387 A1 Jan. 12, 2017

(30) Foreign Application Priority Data

Jul. 7, 2015 (CN) ..... 2015 1 0532739

(51) Int. Cl.
*D03D 1/00* (2006.01)
*D03D 15/00* (2006.01)

(52) U.S. Cl.
CPC ..... *D03D 1/0088* (2013.01); *D03D 15/00* (2013.01); *D10B 2101/12* (2013.01); *D10B 2101/20* (2013.01); *D10B 2401/16* (2013.01)

(58) Field of Classification Search
CPC .. D03D 1/0088; D03D 15/00; D10B 2101/12; D10B 2101/20; D10B 2401/16
See application file for complete search history.

(56) References Cited

U.S. PATENT DOCUMENTS

| | | | | |
|---|---|---|---|---|
| 4,103,102 | A | 7/1978 | Klein | |
| 6,381,482 | B1 | 4/2002 | Jayaraman | |
| 6,729,025 | B2 | 5/2004 | Farrell et al. | |
| 2012/0111614 | A1 | 5/2012 | Free | |
| 2014/0170920 | A1* | 6/2014 | Manipatruni | D03D 1/0088 442/188 |

OTHER PUBLICATIONS

Locher, et al., Routing Methods Adapted to e-Textiles, 2004, International Symposium on Microelectronics (IMAPS), Long Beach , CA, USA.*

(Continued)

*Primary Examiner* — Cephia D Toomer
(74) *Attorney, Agent, or Firm* — Charles E. Bergere

(57) ABSTRACT

A woven signal-routing substrate for a wearable electronic device has conductive warps and wefts that are woven with each other and with insulative warps and wefts. Woven electrical cross-connections are formed at some of the intersections of the conductive warps and wefts, while no electrical cross-connections are formed at other intersections, to provide a signal-routing architecture for the substrate that can be used to route signals between electronic components of the wearable device. Non-connecting intersections are formed using insulative warps that are sufficiently thicker than the relatively thin conductive warps to enable a conductive weft to cross a conductive warp without making physical contact at intersection locations where an electrical cross-connection is not desired. The woven electrical cross-connections may be formed at other intersection locations using weaving topologies that ensure that the corresponding mutually orthogonal warps and wefts do contact one another.

17 Claims, 6 Drawing Sheets

(56) References Cited

OTHER PUBLICATIONS

Vatansever et al., Smart Woven Fabrics in Renewable Energy Generation, 2011, InTech: Rijeka, Croatia, pp. 23-38.*
Nihei et al., "Low-resistance Multi-walled Carbon Nanotube Vias with Parallel Channel Conduction of Inner Shells", Fujitsu Limited, Interconnect Technology Conference, Jun. 2005.

* cited by examiner

100

510

WOVEN SIGNAL-ROUTING SUBSTRATE FOR WEARABLE ELECTRONIC DEVICES

BACKGROUND

The present invention relates to fabric-based electronic devices and, more particularly, to techniques for forming electrical cross-connections between orthogonal electrical conductors in woven signal-routing substrates for wearable electronic devices and the like.

There is much interest in integrating electronics and fabrics to produce wearable consumer electronics products. U.S. Pat. No. 6,381,482 describes a woven or knitted fabric having flexible information infrastructure integrated within the fabric. In some embodiments, the information infrastructure includes insulated, electrical conducting fibers that are woven into the fabric along with conventional non-conducting cotton or synthetic fibers. Electrical cross-connections are formed between two orthogonal electrical conducting fibers by removing the outer insulating material at their intersection and applying conductive paste to maintain physical and electrical contact between the two fibers. Such techniques for forming electrical cross-connections are expensive to fabricate and susceptible to breaking and other failures, especially for flexible fabrics.

BRIEF DESCRIPTION OF THE DRAWINGS

Embodiments of the invention will become more fully apparent from the following detailed description, the appended claims, and the accompanying drawings in which like reference numerals identify similar or identical elements.

DETAILED DESCRIPTION

Figure 1:
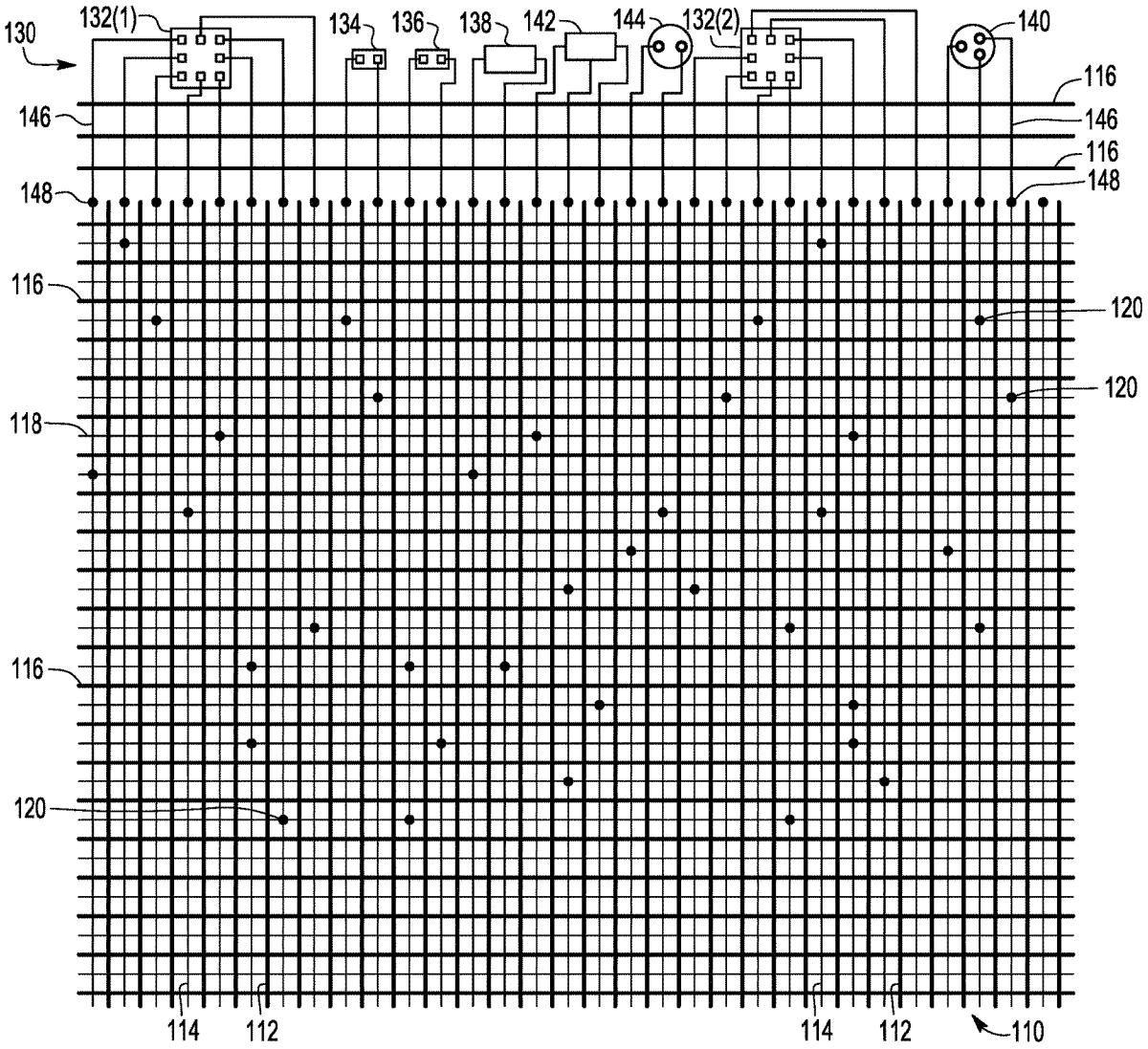
FIG. 1 is a schematic representation of a portion of a wearable electronic device according to one embodiment of the invention.

Detailed illustrative embodiments of the present invention are disclosed herein. However, specific structural and functional details disclosed herein are merely representative for purposes of describing example embodiments of the present invention. The present invention may be embodied in many alternate forms and should not be construed as limited to only the embodiments set forth herein. Further, the terminology used herein is for the purpose of describing particular embodiments only and is not intended to be limiting of example embodiments of the invention.

As used herein, the singular forms "a," "an," and "the," are intended to include the plural forms as well, unless the context clearly indicates otherwise. It further will be understood that the terms "comprises," "comprising," "includes," and/or "including," specify the presence of stated features, steps, or components, but do not preclude the presence or addition of one or more other features, steps, or components. It also should be noted that in some alternative implementations, the functions/acts noted may occur out of the order noted in the figures. For example, two figures shown in succession may in fact be executed substantially concurrently or may sometimes be executed in the reverse order, depending upon the functionality/acts involved.

In one embodiment, an article of manufacture comprises a woven layer comprising (i) a plurality of thick insulative warps interleaved with and substantially parallel to a plurality of thin conductive warps that are thinner than the thick insulative warps, (ii) a plurality of insulative wefts interleaved with and substantially parallel to a plurality of conductive wefts, wherein the warps are woven with the wefts, and (iii) one or more woven electrical cross-connections, each comprising at least one thin conductive warp physically contacting at least one conductive weft. The relative thicknesses between the thick insulative warps and the thin conductive warps enable at least one thin conductive warp to cross at least one conductive weft without making physical contact at an intersection not having an electrical cross-connection.

As used in this specification, the term "conductive fiber" refers to a fiber having a conducting outer surface. Thus, an un-insulated electrical carbon fiber is a type of conductive fiber. A thin, un-insulated copper wire may be considered as another type of conductive fiber. When two orthogonal, conductive fibers physically contact one another, they form a woven electrical cross-connection at the location of their intersection.

Similarly, as used in this specification, the term "insulative fiber" refers to a fiber having a non-conducting outer surface whether or not they have conducting or non-conducting interiors. Thus, a non-conducting cotton, wool, or synthetic fiber is a type of insulative fiber. A thin, insulated copper wire having a non-conducting outer (e.g., plastic) coating or covering is another type of insulative fiber, because an insulated copper wire will not form an electrical cross-connection when physically contacting an orthogonal conductive fiber. An insulated electrical carbon fiber is another type of insulative fiber.

Two mutually orthogonal, conductive fibers that physically contact (and therefore short to) one another will form an electrical short that functions as an electrical cross-connection. Two mutually orthogonal, insulative fibers that physically contact one another will not form an electrical cross-connection. Similarly, a conductive fiber that physically contacts an orthogonal, insulative fiber will also not form an electrical cross-connection.

As used in this specification, a woven signal-routing substrate comprises a woven layer of warps (i.e., vertical fibers) woven with wefts (i.e., horizontal fibers) in which some of the warps and some of the wefts are conductive fibers that can carry electrical (e.g., power or data) signals between electrical components that may be mounted on or otherwise supported by the substrate. At certain locations in the woven layer, crossing conductive warps and wefts physically contact one another to form woven electrical cross-connections that function as electrical nodes in a signal-routing architecture formed by the conductive warps and wefts. At other locations in the woven layer, conductive warps and wefts cross but do not physically contact (and do not short to) one another and therefore do not form electrical cross-connections at those intersections.

Depending on desired characteristics such as current load and mechanical strength, the various conductive and insulative warps and wefts in a woven signal-routing substrate may be either single-strand or multi-strand fibers, including substrates having both single-strand fibers and multi-strand fibers. In general, each non-conducting warp, each non-conducting weft, each conducting warp, and each conducting weft may independently be either a single-strand fiber or a multi-strand fiber, depending on the particular application.

According to at least some embodiments, woven signal-routing substrates of the invention have multiple instances of three different types of topology for conductive fibers: (1) woven electrical cross-connections between conductive warps and wefts, (2) non-connecting crossings between conducting warps and wefts, and (3) weft-only weaving of conductive wefts. As explained below, there different types of topology are employed to form a woven signal-routing substrate that provides a network of electrically connected conductive fibers that are woven into and form an integral part of the overall woven layer.

FIG. 1 is a schematic representation of a portion of a wearable electronic product 100 comprising a woven signal-routing substrate 110 electrically connected to a number of different electrical components 130, such as, for example, integrated circuit (IC) dies 132(1) and 132(2); discrete circuit elements like resistor 134, capacitor 136, inductor 138, and transistor 140; battery 142; and switch 144.

The substrate 110 comprises (relatively) thick, insulative warps 112 and (relatively) thin, conductive warps 114 that are woven with (relatively) thick, insulative wefts 116 and (relatively) thin, conductive wefts 118. A subset of the intersections of the conductive warps 114 and the conductive wefts 118 form electrical cross-connections 120, represented by circles in FIG. 1. Intersections without circles represent crossings between the conductive warps 114 and the conductive wefts 118 that do not form electrical cross-connections.

The electrical components 130 are electrically connected to conducting leads 146 that are in turn connected to conductive warps 114 at electrical in-line connections 148. In this way, the woven signal-routing substrate 110 functions as a substrate that routes signals between the different electrical components 130. For embodiments (not explicitly represented in FIG. 1) in which the electrical components 130 are also physically supported by the substrate 110, the woven signal-routing substrate 110 functions like a printed circuit board (PCB) or other conventional surface mount technology (SMT) that physically supports and electrically interconnects a number of electrical components to form an electronic system. Because the woven signal-routing substrate 110 has physical characteristics similar to those of conventional woven fabrics, the substrate 110 can be used to form wearable electronics, such as the wearable electronic product 100 of FIG. 1.

As described further below, depending on the particular implementation, each electrical cross-connection 120 in substrate 110 is formed between one or more vertical conductive fibers and one or more horizontal conductive fibers. In one possible implementation illustrated in FIG. 5, each electrical cross-connection is implemented using a single conductive warp and two conductive wefts, where the two conductive wefts may be two distinct conductive fibers or a single conductive fiber that is folded back upon itself. In another possible implementation illustrated in FIG. 7, each electrical cross-connection is implemented using a single conductive warp and a single conductive weft.

Although the warp and weft patterns in the substrate 110 involve (i) alternating insulative and conductive warps and (ii) alternating insulative and conductive wefts, as explained further below, other substrates of the invention may have other and different warp and/or weft patterns.

As shown in FIG. 1, each electrical component 130 has one or more leads 146, where each lead 146 provides a signal path between a corresponding bond pad (not shown) on the electrical component 130 and a corresponding conductive warp 114. Depending on the implementation, the leads 146 may be any suitable conductor structures such as, for example, metal wires, electrical carbon fibers, or carbon nanotubes. In some embodiments, pre-formed conductor structures are bonded to the bond pads, while, in other embodiments, the conductor structures may be grown in situ from the bond pads. For example, carbon nanotubes may be grown in situ from the bond pads using a technique described in M. Nihei et al., "Low resistance Multi-walled Carbon Nanotube Vias with Parallel Channel Conduction of Inner Shells," IEEE (0-7803-8752-X/05) 2005.

In some embodiments, an electrical component 130 and its bonded leads 146 are all mounted on and secured to a planar adhesive tape using conventional integrated circuit (IC) package assembly techniques that can then be attached to the substrate 110. In addition or instead, the component leads 146 can be treated as extensions of the inductive warps 114 and woven with some of the insulative wefts 116, as indicated in FIG. 1.

Figure 2:
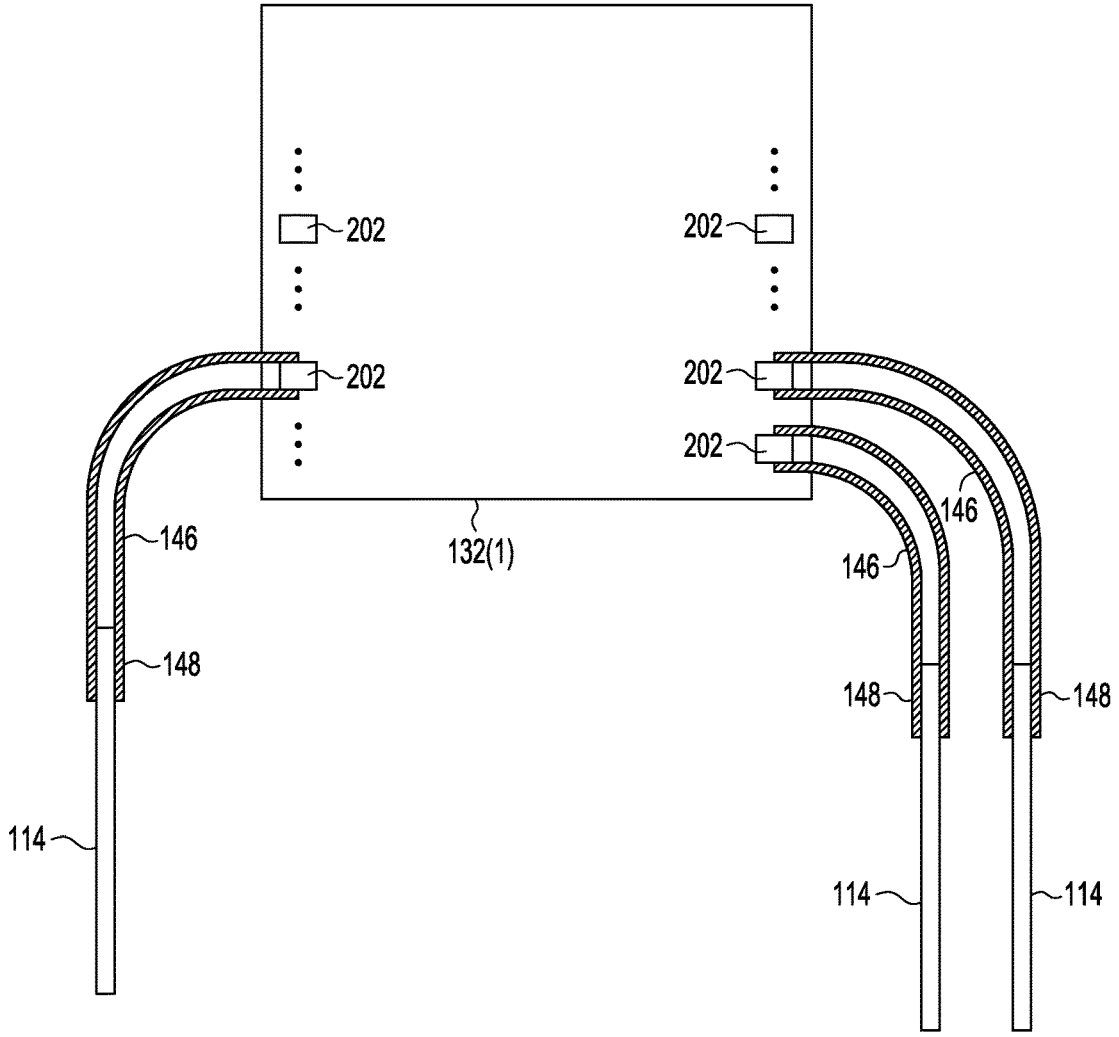
FIG. 2 is a top plan view showing the electrical connections between an integrated circuit (IC) die and three conductive warps of FIG. 1.
Figure 3:
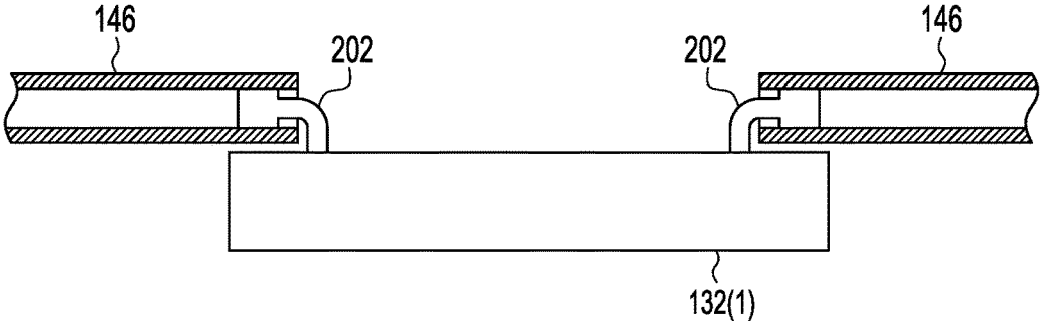
FIG. 3 is a cross-sectional side view showing a portion of the IC die of FIG. 2 having 90° metal bumps formed on its die pads and connected to conductive nanotube leads.

FIG. 2 is a top plan view showing the electrical connections between the IC die 132(1) and three of the conductive warps 114 of FIG. 1. FIG. 3 is a cross-sectional side view of the IC die 132(1) of FIG. 2. As shown in FIGS. 2 and 3, the IC die 132(1) has 90° metal bumps 202 formed on its die pads (not explicitly shown). Each lead 146 is a conductive carbon nanotube that fits onto and secures to a different metal bump 202 at one end of the lead 146 and receives the corresponding conductive warp 114 at the other end of the lead 146 to form an in-line electrical connection 148.

In one possible assembly technique, the carbon nanotubes are heated such that the size of the openings at their ends expands. One end of a heated carbon nanotube is then placed over the corresponding metal bump 202 and the corresponding conductive warp 114 is inserted into the other end of the heated carbon nanotube. When the nanotube cools, the size of the openings at the nanotube ends contract, thereby securing the nanotube in place as a corresponding lead 146 between the die bump 202 and the conductive warp 114.

Figure 4A:
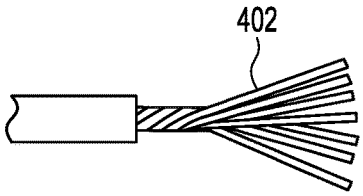
FIGS. 4A-4E are side views representing another technique for forming in-line electrical connections between component leads and conductive warps of FIG. 1.
Figure 4B:
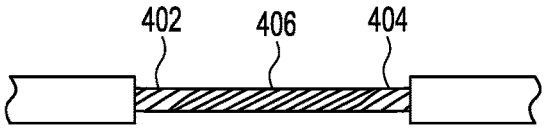
Figure 4C:
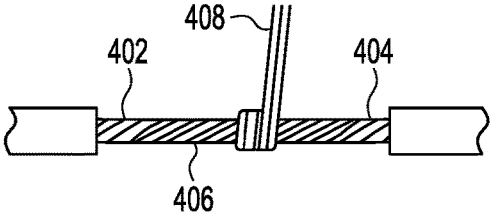
Figure 4D:
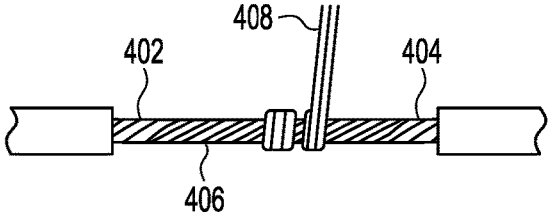
Figure 4E:
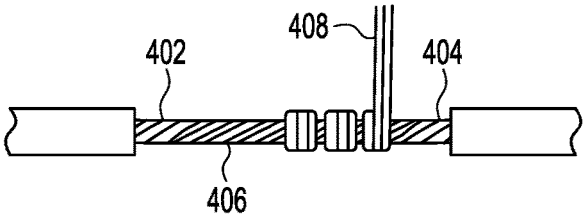

FIGS. 4A-4E are side views representing another technique for forming the in-line electrical connections 148 between the component leads 146 and the conductive warps 114 of FIG. 1. FIG. 4A shows a multi-strand fiber 402, and FIG. 4B shows the interleaving 406 of strands from two multi-strand fibers 402 and 404. FIGS. 4C-4E show how the strands 408 from one of the two multi-strand fibers 402 and 404 can be wrapped around the interleaving 406 to hold the two fibers 402 and 404 together.

In one implementation, the multi-strand fiber 402 may be a multi-strand component lead 146, and the multi-strand fiber 404 may be a multi-strand conductive warp 114. If the strands 408 are from a metal lead 146, then the wrap should stay in place without unwinding. If the strands 408 are carbon fibers from either a fiber lead 146 or the conductive warp fiber 114, then some gel or other appropriate substance (not shown) may be applied to keep the strands 408 from unwinding.

Figure 5:
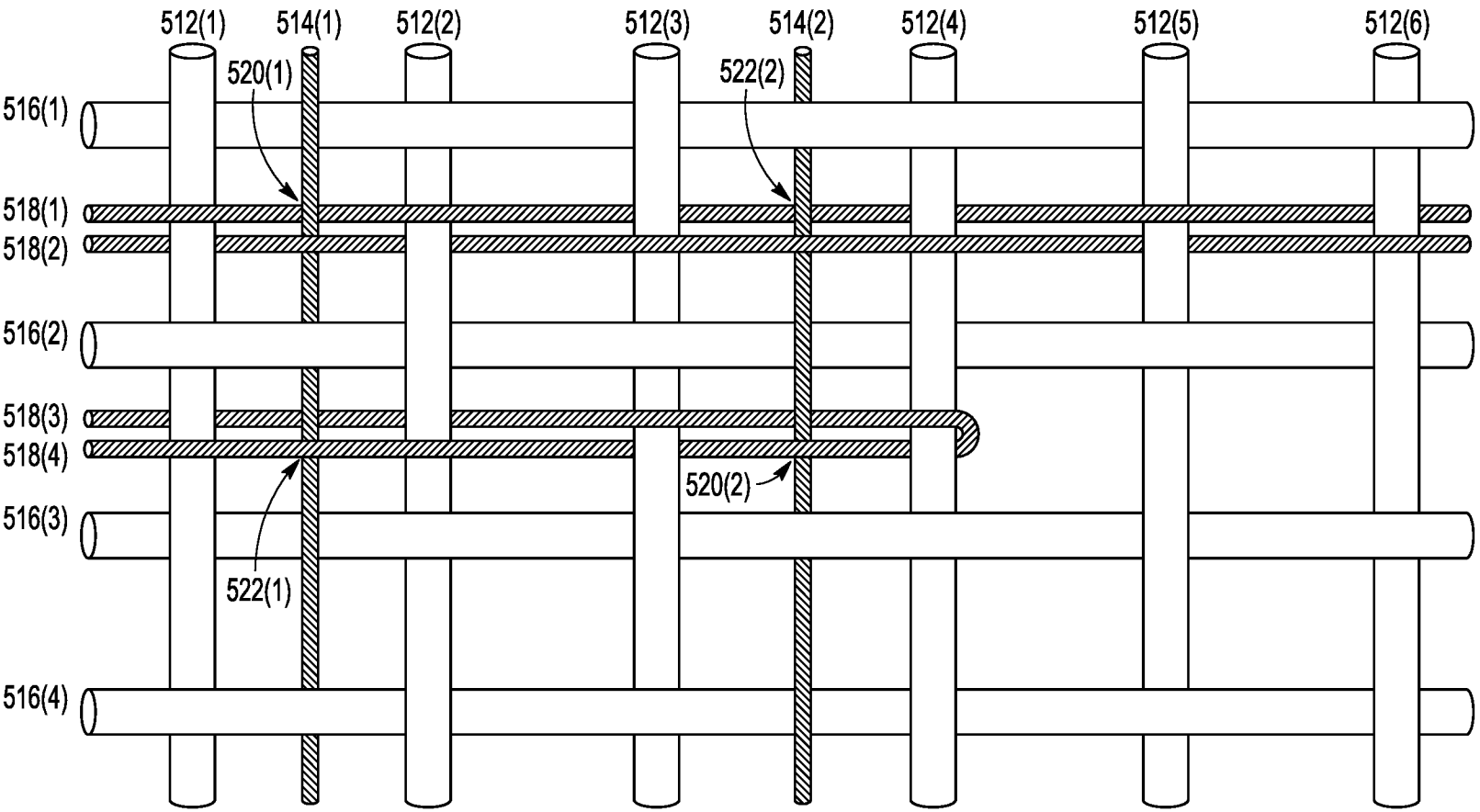
FIG. 5 is a representation of a portion of a woven signal-routing substrate that can be used in the wearable electronic device of FIG. 1 according to one embodiment of the invention.

FIG. 5 is a representation of a portion of a woven signal-routing substrate 510 according to one embodiment of the invention. FIG. 5 shows portions of the following fibers that are part of the substrate 510:

Six thick insulative warps 512(1)-512(6);

Two thin conductive warps 514(1)-514(2);

Four thick insulative wefts 516(1)-516(4); and

Four thin conductive wefts 518(1)-518(4).

Unlike the regular, alternating warp and weft patterns of the substrate 110 of FIG. 1, the substrate 510 has irregular warp and weft patterns. For clarity, the adjacent warps 512 and 514 and the adjacent wefts 516 and 518 of the substrate 510 are illustrated in FIG. 5 separated from one another. In most real-world implementations, the adjacent warps 512 and 514 and the adjacent wefts 516 and 518 will be much closer to one another and may even abut one another along their lengths.

The conductive warp 514(1) and the two mutually adjacent, conductive wefts 518(1) and 518(2) form a first electrical cross-connection 520(1), while the conductive warp 514(2) and the two mutually adjacent, conductive wefts 518(3) and 518(4) form a second electrical cross-connection 520(2). Meanwhile, the conductive warp 514(1) crosses the two mutually adjacent, conductive wefts 518(3) and 518(4) at a location 522(1) without forming an electrical cross-connection, and the conductive warp 514(2) crosses the two mutually adjacent, conductive wefts 518(1) and 518(2) at a location 522(2) also without forming an electrical cross-connection.

As represented in the view shown in FIG. 5, the conductive weft 518(1) passes in front of the insulative warp 512(1), behind the conductive warp 514(1), and in front of the insulative warp 512(2). As a result, the conductive weft 518(1) applies a force to the conductive warp 514(1) in the forward direction (i.e., out of the page of FIG. 5). Meanwhile, the conductive weft 518(2) passes behind the insulative warp 512(1), in front of the conductive warp 514(1), and behind the insulative warp 512(2). As a result, the conductive weft 518(2) applies a force to the conductive warp 514(1) in the backward direction (i.e., into the page of FIG. 5). The opposing forward and backward forces and the proximity of the conductive weft 518(1) to the conductive weft 518(2) results in secure physical contact between all three conductive fibers, thereby ensuring that the three conductive fibers are shorted together to form the first electrical cross-connection 520(1), which functions as an electrical node in the woven signal-routing substrate 510 connecting two orthogonal "wires": one corresponding to the conductive warp 514(1) and the other corresponding to the two adjacent, conductive wefts 518(1) and 518(2).

In a similar manner, the conductive warp 514(2) and the two adjacent, conductive wefts 518(3) and 518(4) physically contact one another to form the second electrical cross-connection 520(2).

On the other hand, the conductive weft 518(3) passes behind the insulative warp 512(1), behind the conductive warp 514(1), and behind the insulative warp 512(2). Meanwhile, the conductive weft 518(4) passes in front of the insulative warp 512(1), in front of the conductive warp 514(1), and in front of the insulative warp 512(2). Due to the fact that the thick insulative warps 512(1) and 512(2) are much thicker than the thin conductive warp 514(1), the conductive warp 514(1) passes between the conductive wefts 518(3) and 518(4) without physically contacting either of those two fibers. In this way, conductive warp 514(1) crosses the two conductive wefts 518(3) and 518(4) without forming an electrical cross-connection at the location 522(1).

In a similar manner, the conductive warp 514(2) crosses between the conductive wefts 518(1) and 518(2) also without forming an electrical cross-connection at the location 522(2).

Note that, ignoring the thin conductive warps 514 and wefts 518, the thick insulative warps 512 and wefts 516 follow a regular alternating weaving pattern. Furthermore, the conductive warps 514 weave in and out in a regular, alternating weaving pattern with respect to the insulative wefts 516. For example, the conductive warp 514(1) passed in front of insulative weft 516(1), behind insulative weft 516(2), in front of insulative weft 516(3), and behind insulative weft 516(4). Such regular, alternating weaving, whenever available, results in a stronger fabric. Nevertheless, in other embodiments of the invention, the various warps and wefts do not have to follow such a regular alternating weaving pattern.

Note that there are no conductive warps between the adjacent insulative warps 512(2) and 512(3), nor between the adjacent insulative warps 512(4) and 512(5), nor between the adjacent insulative warps 512(5) and 512(6). In those situations, the conductive wefts 518 weave in and out of the adjacent insulative warps 512. For example, the conductive weft 518(1) passes in front of the insulative warp 512(2) and behind the insulative warp 512(3). Similarly, the conductive weft 518(2) passes behind the insulative warp 512(2) and in front of the insulative warp 512(3). In that case, the conductive weft 518(1) may physically contact the conductive weft 518(2) as they pass by each other. This is not a problem since such pairs of mutually adjacent, conductive wefts 518 are assumed to be at the same voltage potential. Here, too, this alternating weaving pattern may be advantageous, but is not required.

Note also that there are no conductive wefts between the adjacent insulative wefts 516(3) and 516(4).

Note further that conductive wefts 518(3) and 518(4) are formed from a single, folded conductive fiber that returns upon itself, where that fiber is folded over between insulative warps 512(4) and 512(5) without reaching the (right) edge of the substrate 510.

In some embodiments, after the substrate is woven, a non-conducting sealant, such as those used in conventional textile industries, is applied that dries or otherwise cures to protect and encapsulate the electrical cross-connections as well as the non-connecting intersections to enhance the integrity of the woven signal-routing substrate. In addition to or instead of employing the encapsulating sealant, the substrate can be sandwiched between two or more insulating, protective layers to form a laminated fabric.

Although the invention has been described in the context of woven signal-routing substrates made from thick insulative warps and wefts and thin conductive warps and wefts, the invention is not so limited. For example, a woven signal-routing substrate of the invention could be made from thick insulative warps, thin conductive warps, and insulated and conductive wefts that have any suitable relative and absolute thicknesses. For example, the insulated wefts and the conductive wefts could have the same thickness. The conductive wefts could even be thicker than the insulative wefts. The important relative thicknesses are those of the insulative and conductive warps, where the conductive warps need to be sufficiently thinner than the insulative warps such that a conductive warp is able to cross a conductive weft (that is offset from the orthogonal conductive warp by the two (thick) insulative warps on either side of the conductive warp) without physically contacting the conductive weft to provide a warp/weft intersection at which an electrical cross-connection is not desired.

Figure 6:
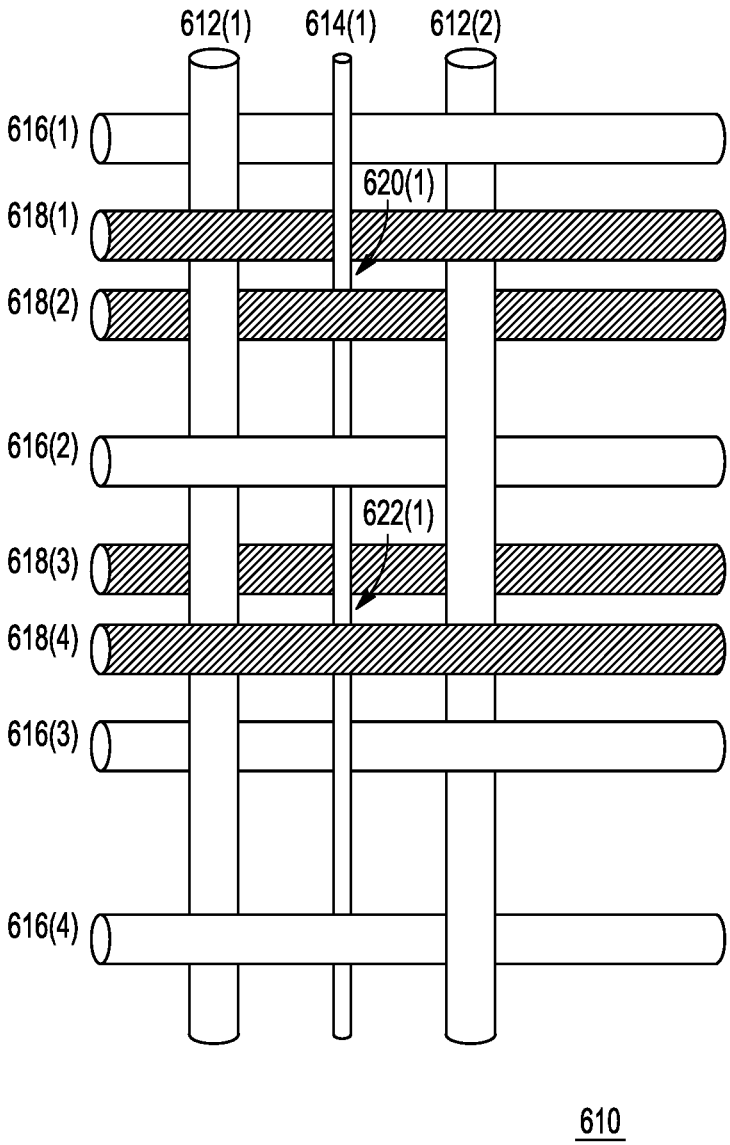
FIG. 6 is a representation of a portion of a woven signal-routing substrate that can be used in the wearable electronic device of FIG. 1 according to another embodiment of the invention.

FIG. 6 is a representation of a portion of a woven signal-routing substrate 610 according to another embodiment of the invention. Unlike the substrate 510 of FIG. 5, in which the conductive wefts 518 are thinner than the insulative wefts 516, in the substrate 610, the conductive wefts 618 have substantially the same thickness as the insulative wefts 616. FIG. 6 shows portions of the following fibers that are part of the substrate 610:

Two thick insulative warps 612(1)-612(2);
One thin conductive warp 614(1);
Four (thick) insulative wefts 616(1)-616(4); and
Four (thick) conductive wefts 618(1)-618(4).

In a manner similar to the electrical cross-connections 520(1) and 520(2) of FIG. 5, the conductive warp 614(1) and the two mutually adjacent, conductive wefts 618(1) and 618(2) form an electrical cross-connection 620(1). Meanwhile, in manner similar to the intersections 522(1) and 522(2) of FIG. 5, the conductive warp 614(1) crosses the two mutually adjacent, conductive wefts 618(3) and 618(4) at a location 622(1) without forming an electrical cross-connection. The substrate 610 demonstrates that, in order to enable non-connecting intersections of conductive warps and wefts, the relative thicknesses of the insulative and conductive warps are important, not the relative thicknesses of the insulative and conductive wefts.

The invention has been described in the context of the woven signal-routing substrates 510 and 610 of FIGS. 5 and 6 in which each electrical cross-connection 520/620 is of a first type formed between one conductive warp 514/614 and two conductive wefts 518/618. In other embodiments, electrical cross-connections can be of a second type formed between two vertical warps and one horizontal weft, either in addition to or instead of the first type of electrical cross-connections.

Some of the claims recite electrical cross-connections formed between a single conductive warp and two conductive wefts. Under one possible interpretation, the terms "warp" and "weft" are interchangeable. Under this interpretation, when a woven signal-routing substrate of the invention is rotated about a normal axis by 90 degrees, the vertical warps become horizontal wefts, and vice versa. As such, the claims should be interpreted such that recitations of warps and wefts refer to any mutually orthogonal fibers. Thus, for example, the recitation of a woven electrical cross-connection formed between one warp and two wefts should also be interpreted as covering a woven electrical cross-connection between one weft and two warps.

Although the invention has been described in the context of woven electrical cross-connections formed between one warp and two wefts, in general, each woven electrical cross-connection may be formed between one or more warps and one or more wefts.

Figure 7:
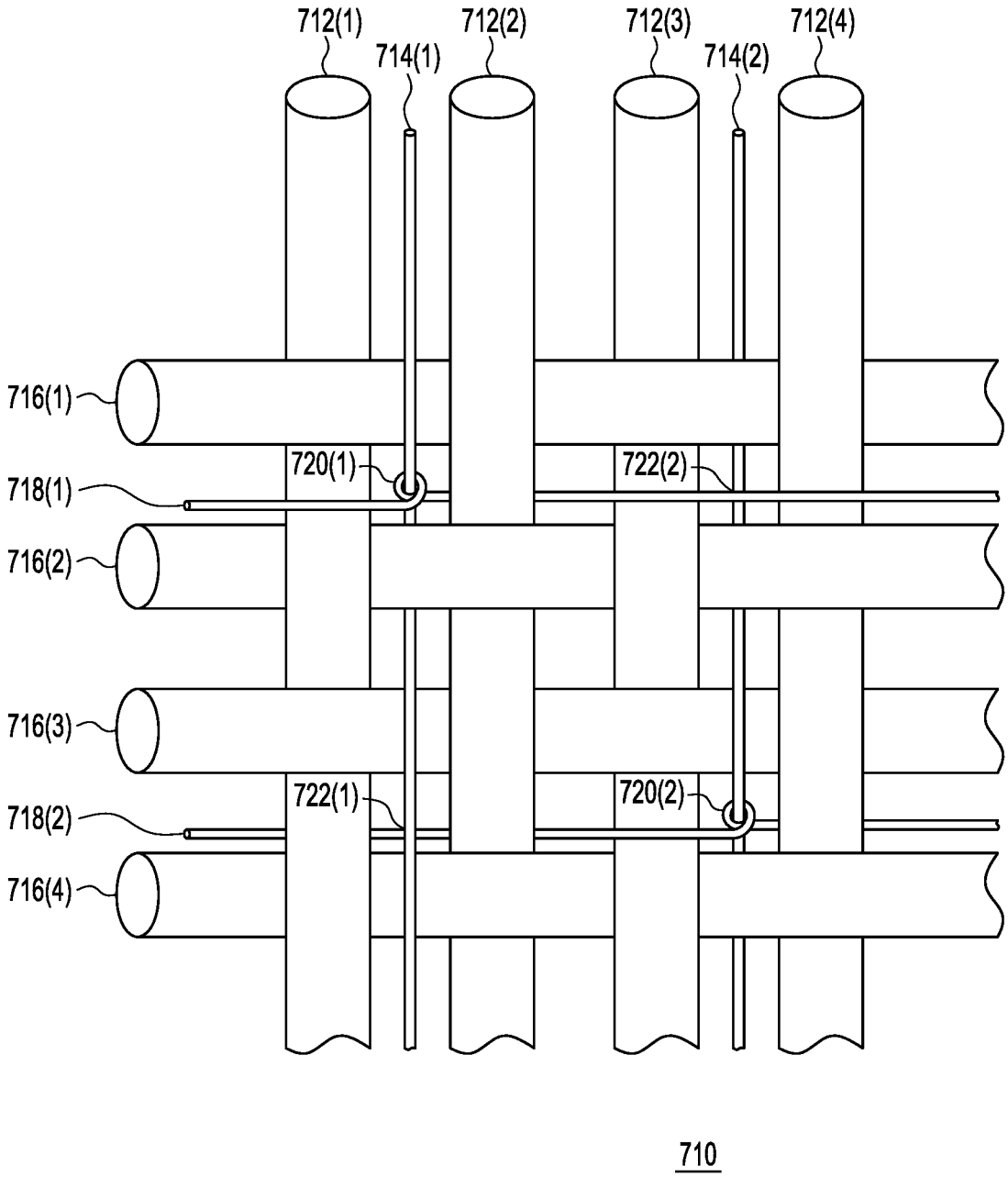
FIG. 7 is a representation of a portion of a woven signal-routing substrate that can be used in the wearable electronic device of FIG. 1 according to yet another embodiment of the invention.

FIG. 7 is a representation of a portion of a woven signal-routing substrate 710 according to yet another embodiment of the invention. Unlike the substrates 510 and 610 of FIGS. 5 and 6, in which each woven electrical cross-connection is formed between one warp and two wefts, in the substrate 710, each woven electrical cross-connection 720 is formed between one conductive warp 714 and one conductive weft 718. FIG. 7 shows portions of the following fibers that are part of the substrate 710:

Four thick insulative warps 712(1)-712(4);
Two thin conductive warps 714(1)-714(2);
Four thick insulative wefts 716(1)-716(4); and
Two thin conductive wefts 718(1)-718(4).

As shown in FIG. 7, the conductive weft 718(1) forms an electrical cross-connection 720(1) with the conductive warp 714(1) by wrapping around the conductive warp 714(1). In a similar manner, the conductive weft 718(2) forms an electrical cross-connection 720(2) with the conductive warp 714(2).

Meanwhile, the conductive weft 718(2) crosses the conductive warp 714(1) at location 722(1) without forming an electrical cross-connection, and the conductive weft 718(1) likewise crosses the conductive warp 714(2) at location 722(2) without forming an electrical cross-connection. Similar to the situation in the substrates 510 and 610 of FIGS. 5 and 6, the absence of electrical cross-connections at these two locations 722(1) and 722(2) is due to the insulative warps 712 being much thicker than the conductive warps 714, thereby providing physical clearance for the conductive warps and wefts to cross without touching each other in locations where electrical cross-connections are not desired.

The invention has been described in the context of the wearable electronic product 100 of FIG. 1 in which the electrical components 130 are electrically connected to the conductive warps 114. In other embodiments, a wearable electronic product can have one or more electrical components that are analogously electrically connected to conductive wefts, either in addition to or instead of electrical components electrically connected to conductive warps.

In some embodiments, one component lead may be connected to another component lead via different redundant signal-routing paths in the substrate to provide fault protection in case one or more electrical cross-connections or fibers should break or otherwise fail.

The invention has been described in the context of woven signal-routing substrates having vertical warps and horizontal wefts that are mutually orthogonal. In other contexts, woven signal-routing substrates of the invention may have two sets of insulative and conductive fibers that are not mutually orthogonal. In still other contexts, woven signal-routing substrates may have more than two sets of fibers woven together at various angles (e.g., three sets of fibers 60 degrees apart). In such embodiments, it is not necessary for every set of fibers to include conductive fibers, as long as at least two sets do. As used in the claims, the terms "warp" and "weft" should be interpreted to cover both orthogonal as well as non-orthogonal sets of fibers in fabrics having two or more different fiber sets.

Unless explicitly stated otherwise, each numerical value and range should be interpreted as being approximate as if the word "about" or "approximately" preceded the value or range.

It will be further understood that various changes in the details, materials, and arrangements of the parts which have been described and illustrated in order to explain embodiments of this invention may be made by those skilled in the art without departing from embodiments of the invention encompassed by the following claims.

In this specification including any claims, the term "each" may be used to refer to one or more specified characteristics of a plurality of previously recited elements or steps. When used with the open-ended term "comprising," the recitation of the term "each" does not exclude additional, unrecited elements or steps. Thus, it will be understood that an apparatus may have additional, unrecited elements and a method may have additional, unrecited steps, where the additional, unrecited elements or steps do not have the one or more specified characteristics.

It should be understood that the steps of the exemplary methods set forth herein are not necessarily required to be performed in the order described, and the order of the steps of such methods should be understood to be merely exemplary. Likewise, additional steps may be included in such methods, and certain steps may be omitted or combined, in methods consistent with various embodiments of the invention.

Although the elements in the following method claims, if any, are recited in a particular sequence with corresponding labeling, unless the claim recitations otherwise imply a particular sequence for implementing some or all of those elements, those elements are not necessarily intended to be limited to being implemented in that particular sequence.

Reference herein to "one embodiment" or "an embodiment" means that a particular feature, structure, or characteristic described in connection with the embodiment can be included in at least one embodiment of the invention. The appearances of the phrase "in one embodiment" in various places in the specification are not necessarily all referring to the same embodiment, nor are separate or alternative embodiments necessarily mutually exclusive of other embodiments. The same applies to the term "implementation."

The invention claimed is:

1. An article of manufacture comprising a woven layer, comprising:

a plurality of insulative warps having a first thickness interleaved with and parallel to a plurality of conductive warps having a second thickness that is less than the first thickness of the insulative warps;

a plurality of insulative wefts interleaved with and parallel to a plurality of conductive wefts, wherein the warps are woven with the wefts; and one or more woven electrical cross-connections, each comprising at least one conductive warp physically contacting at least one conductive weft, wherein:

the relative thicknesses between the insulative warps and the conductive warps enable at least one conductive warp to cross at least one conductive weft without making physical contact at an intersection not having an electrical cross-connection.

2. The article of claim 1, wherein:

the wefts are orthogonal to the warps; and the conductive wefts are thinner than the insulative wefts.

3. The article of claim 1, wherein at least one woven cross-connection comprises a first conductive warp and first and second conductive wefts, wherein:

the first and second conductive wefts are both located between first and second adjacent insulative wefts;

the first conductive warp is located between first and second adjacent insulative warps;

the first conductive weft crosses in front of the first insulative warp, behind the first conductive warp, and in front of the second insulative warp; and the second conductive weft crosses behind the first insulative warp, in front of the first conductive warp, and behind the second insulative warp.

4. The article of claim 3, wherein:

the first conductive weft physically contacts the first conductive warp with a forward force; and the second conductive weft physically contacts the first conductive warp with a backward force.

5. The article of claim 3, wherein a second conductive warp crosses the first and second conductive wefts between third and fourth adjacent insulative warps without forming an electrical cross-connection, wherein:

the first conductive weft crosses in front of each of the third insulative warp, the second conductive warp, and the fourth insulative warp;

the second conductive weft crosses behind each of the third insulative warp, the second conductive warp, and the fourth insulative warp; and the thickness of the third and fourth insulative warps prevents physical contact between (i) the second conductive warp and (ii) the first and second conductive wefts.

6. The article of claim 3, wherein:

there are no conductive warps between fifth and sixth insulative warps;

the first conductive weft crosses in front of the fifth insulative warp and behind the sixth insulated warp; and the second conductive weft crosses behind the fifth insulative warp and in front of the sixth insulative warp.

7. The article of claim 1, wherein at least one woven electrical cross-connection comprises a first conductive warp and a first conductive weft, wherein:

the first conductive weft is located between first and second adjacent insulative wefts;

the first conductive warp is located between first and second adjacent insulative warps; and the first conductive weft is wrapped around the first conductive warp.

8. The article of claim 7, wherein:

a second conductive warp crosses the first conductive weft between third and fourth adjacent insulative warps without forming an electrical cross-connection;

the first conductive weft crosses either (i) in front of each of the third insulative warp, the second conductive warp, and the fourth insulative warp or (ii) behind each of the third insulative warp, the second conductive warp, and the fourth insulative warp; and the thickness of the third and fourth insulative warps prevents physical contact between (i) the second conductive warp and (ii) the first conductive weft.

9. The article of claim 1, wherein the conductive warps and wefts are conducting carbon fibers.

10. The article of claim 1, wherein the insulative warps and wefts are non-conducting fibers.

11. The article of claim 1, wherein the woven layer comprised a non-conducting sealant material that protects the woven electrical cross-connections.

12. The article of claim 1, wherein the woven layer is sandwiched between two or more protective layers to form a laminated fabric.

13. The article of claim 1, further comprising a plurality of electrical components supported by the woven layer, each electrical component having one or more conducting leads, each conducting lead electrically connected to one of the conductive warps or one of the conductive wefts.

14. The article of claim 13, wherein a conducting lead of a first electrical component is electrically connected to a conducting lead of a second electrical component via at least two conductive warps/wefts and at least one woven electrical cross-connection.

15. The article of claim 14, wherein the conducting lead of the first electrical component is electrically connected to the conducting lead of the second electrical component via three conductive warps/wefts and two woven electrical cross-connections.

16. The article of claim 13, wherein the article comprises a wearable electronic device comprising the electrical components electrically interconnected by the conductive warps and wefts that are woven into the woven layer, which functions as a signal-routing substrate for the electronic device.

17. The article of claim 13, wherein a conducting lead of a first electrical component is connected to a conducting lead of a second electrical component via different redundant signal-routing paths through the woven layer to provide fault protection.

* * * * *